US006238244B1

(12) United States Patent
Yang

(10) Patent No.: US 6,238,244 B1
(45) Date of Patent: May 29, 2001

(54) SHIELDED ELECTRICAL CONNECTOR WITH SUPERPOSED TERMINALS

(75) Inventor: Sheng-Ho Yang, Taipei Hsien (TW)

(73) Assignee: Advanced Connecteck Inc., Hsintien (TW)

( * ) Notice: Subject to any disclaimer, the term of this patent is extended or adjusted under 35 U.S.C. 154(b) by 0 days.

(21) Appl. No.: 09/570,530

(22) Filed: May 12, 2000

Related U.S. Application Data

(63) Continuation-in-part of application No. 09/339,694, filed on Jun. 24, 1999, now abandoned.

(51) Int. Cl.[7] ..... H01R 13/648

(52) U.S. Cl. ..... 439/607; 439/541.5

(58) Field of Search ..... 439/607–610, 439/541.5

(56) References Cited

U.S. PATENT DOCUMENTS

| | | | |
|---|---|---|---|
| 4,612,602 | 9/1986 | Weyer et al. | 361/394 |
| 5,037,330 | 8/1991 | Fulponi et al. | 439/607 |
| 5,755,595 | 5/1998 | Davis et al. | 439/607 |
| 5,797,770 | 8/1998 | Davis et al. | 439/607 |

*Primary Examiner*—Hien Vu
(74) *Attorney, Agent, or Firm*—Finnegan, Henderson, Farabow, Garrett & Dunner, L.L.P.

(57) ABSTRACT

An electrical connector includes a terminal holding frame, first and second sets of conductive terminals mounted respectively on upper and lower terminal holding plates of the terminal holding frame in a superposed relationship, and a first metal shield that encloses the terminal holding frame. The metal shield has a closed rear side to enhance electromagnetic shielding of the conductive terminals. In addition, a second metal shield encloses a partition plate between the upper and lower terminal holding plates of the terminal holding frame. The second metal shield is formed with a pair of resilient grounding strips disposed forwardly of the partition plate. When the electrical connector is installed in a housing of an electronic appliance, the resilient grounding strips abut against the housing for grounding purposes.

2 Claims, 4 Drawing Sheets

SHIELDED ELECTRICAL CONNECTOR WITH SUPERPOSED TERMINALS

CROSS-REFERENCE TO RELATED APPLICATION

This is a continuation-in-part (CIP) of U.S. patent application Ser. No. 09/339,694, filed on Jun. 24, 1999, and abandoned as of the filing date of this application.

BACKGROUND OF THE INVENTION

1. Field of the Invention

The invention relates to an electrical connector, more particularly to a shielded electrical connector having an insulated terminal holding frame that is capable of holding a plurality of terminals in a superposed relationship such that the superposed terminals will occupy a relatively small amount of space when mounted on a printed circuit board.

2. Description of the Related Art

Reducing the thickness, length and size of a computer, such as a desktop computer or a notebook computer, has always been the goal of manufacturers in the computer industry to make their products more attractive to consumers. However, it is noted that electrical connectors on the main board or the circuit board occupy a significant amount of space on the latter. It is therefore preferable to find some way of reducing the space occupied by an electrical connector on a circuit board without reducing the number of conductive terminals to reduce the size of the circuit board and permit further reduction in the dimensions of a computer.

In U.S. Pat. No. 5,755,595, there is disclosed an electrical connector that includes an insulated terminal holding frame, first and second sets of conductive terminals mounted respectively on upper and lower terminal holding plates of the terminal holding frame in a superposed relationship, and a metal shield that encloses the terminal holding frame. The shielding effect provided by the metal shield to the conductive terminals is inadequate because the metal shield has an open rear side. In addition, the metal shield is formed with a pair of tabs that extend from front edges of left and right shield walls and that are bent toward a partition plate between the upper and lower terminal holding plates of the terminal holding frame. When the electrical connector is installed in a housing of an electronic appliance, the tabs abut against the housing of the electronic appliance for grounding purposes. Because the tabs are formed directly on the metal shield, they cannot be formed to have relatively long lengths. As such, the grounding effect provided thereby is unsatisfactory.

SUMMARY OF THE INVENTION

The object of this invention is to provide an electrical connector having an insulated terminal holding frame that is capable of holding a plurality of conductive terminals in a superposed relationship so that the superposed conductive terminals will occupy a relatively small amount of space when mounted on a printed circuit board.

According to this invention, an electrical connector comprises first and second sets of conductive terminals, a terminal holding frame, and first and second metal shields.

Each of the conductive terminals in each of the first and second sets has a horizontal contact portion with front and rear sections, and an upright tail portion extending downwardly from the rear section of the horizontal contact portion.

The terminal holding frame is formed from an insulator material, and includes a front wall, upper and lower terminal holding plates extending forwardly and horizontally from the front wall, a partition plate extending forwardly and horizontally from the front wall between the upper and lower terminal holding plates, and upper and lower terminal positioning plates extending rearwardly and horizontally from the front wall such that the upper terminal positioning plate is disposed at an elevation between the upper and lower terminal holding plates, and such that the lower terminal positioning plate is disposed at an elevation below the lower terminal holding plate. The front wall is formed with an upper set of through holes to permit the front sections of the horizontal contact portions of the first set of conductive terminals to extend therethrough for mounting the front sections of the horizontal contact portions of the first set of conductive terminals on the upper terminal holding plate. The upper terminal positioning plate has a rear edge and is formed with a plurality of first notches that extend from the rear edge toward the front wall to permit the upright tail portions of the first set of conductive terminals to extend downwardly through the upper terminal positioning plate. The front wall is further formed with a lower set of through holes to permit the front sections of the horizontal contact portions of the second set of conductive terminals to extend therethrough for mounting the front sections of the horizontal contact portions of the second set of conductive terminals on the lower terminal holding plate. The lower terminal positioning plate has a rear edge and is formed with a plurality of second notches that extend from the rear edge toward the front wall to permit the upright tail portions of the first and second sets of conductive terminals to extend downwardly through the lower terminal positioning plate and to project beyond a bottom edge of the front wall.

The first metal shield includes first top and bottom walls, first left and right walls interconnecting the first top and bottom walls, and a rear wall connected to a rear edge of at least one of the first top, bottom, left and right walls. The first metal shield encloses the terminal holding frame such that the rear wall is disposed rearwardly of the upper and lower terminal positioning plates so as to enhance electromagnetic shielding of the first and second sets of conductive terminals.

The second metal shield includes second top and bottom walls, and second left and right walls interconnecting the second top and bottom walls. The second top, bottom, left and right walls cooperatively form a front open end. The second metal shield further includes a pair of resilient grounding strips that extend into the front open end from a respective one of the second left and right walls. The second metal shield encloses the partition plate such that the resilient grounding strips are disposed forwardly of the partition plate.

Thus, when the electrical connector is installed in a housing of an electronic appliance, the resilient grounding strips on the second metal shield are adapted to abut against the housing of the electronic appliance for grounding purposes.

In the preferred embodiment, at least one of the first top, bottom, left and right walls of the first metal shield and the second top and bottom walls of the second metal shield is formed with a resilient tongue that projects into an interior of the first metal shield. In addition, at least one of the second left and right walls of the second metal shield is formed with a resilient tongue for engaging the first left and right walls of the first metal shield.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
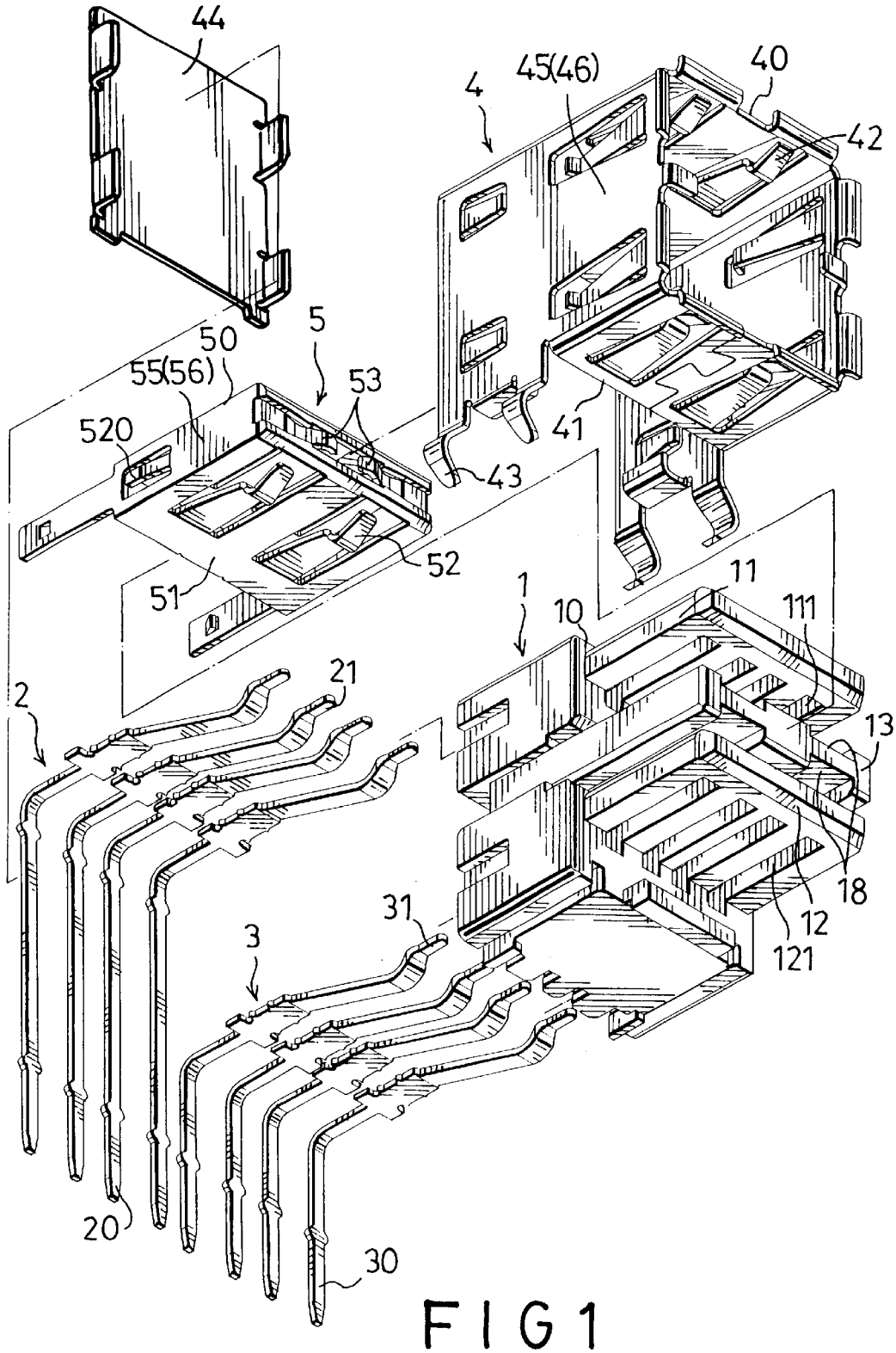
FIG. 1 is an exploded view of the preferred embodiment of an electrical connector of the present invention.
Figure 2:
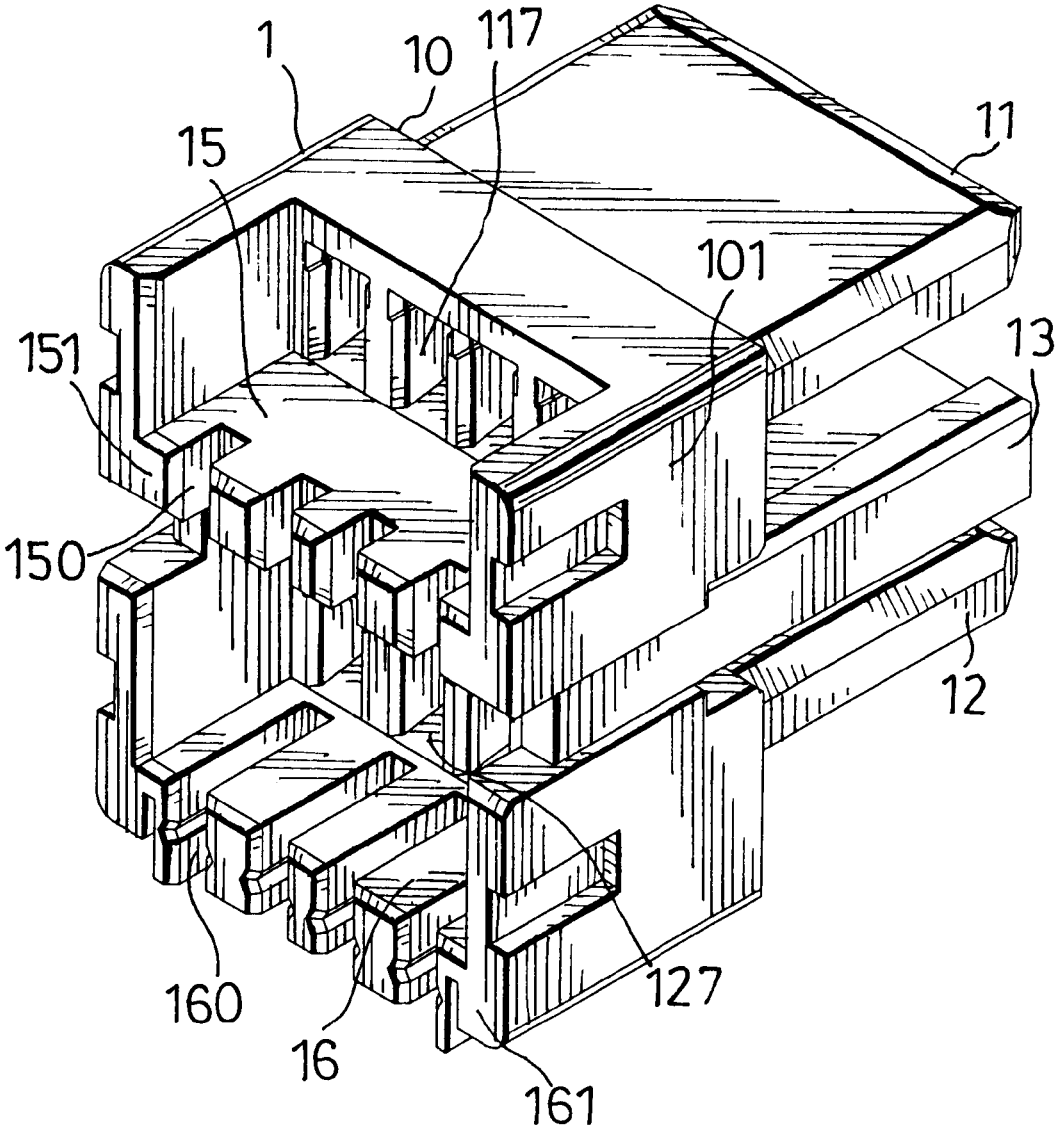
FIG. 2 is perspective view of a terminal holding frame utilized in the preferred embodiment.

Referring to FIGS. 1 and 2, the preferred embodiment of an electrical connector according to the present invention is shown to include first and second sets of conductive terminals 2,3, a terminal holding frame 1 formed integrally from an insulator material, and first and second rectangular metal shields 4,5.

As illustrated, there are four conductive terminals 2,3 in each of the first and second sets. Each of the conductive terminals 2, 3 in each of the first and second sets has a horizontal contact portion 21, 31 with front and rear sections, and an upright tail portion 20, 30 that extends downwardly from the rear section of the horizontal contact portion 21, 31.

The terminal holding frame 1 includes a front wall 10 with opposite lateral edges, two lateral walls 101 that extend rearwardly and respectively from the lateral edges of the front wall 10, upper and lower terminal holding plates 11, 12 that extend forwardly and horizontally from the front wall 10, a partition plate 13 that extends forwardly and horizontally from the front wall 10 between the upper and lower terminal holding plates 11, 12, and upper and lower terminal positioning plates 15,16 that extend rearwardly and horizontally from the front wall 10 such that the upper terminal positioning plate 15 is disposed at an elevation between the upper and lower terminal holding plates 11, 12, and such that the lower terminal positioning plate 16 is disposed at an elevation below the lower terminal holding plate 12. The front wall 10 is formed with an upper set of through holes 117 to permit the front sections of the horizontal contact portions 21 of the first set of conductive terminals 2 to extend therethrough for mounting the front sections of the horizontal contact portions 21 of the first set of conductive terminals 2 on the upper terminal holding plate 11. The upper terminal positioning plate 15 has a rear edge 151 and is formed with four first notches 150 that extend from the rear edge 151 toward the front wall 10 to permit the upright tail portions 20 of the first set of conductive terminals 2 to extend downwardly through the upper terminal positioning plate 15. The front wall 10 is further formed with a lower set of through holes 127 to permit the front sections of the horizontal contact portions 31 of the second set of conductive terminals 3 to extend therethrough for mounting the front sections of the horizontal contact portions 31 of the second set of conductive terminals 3 on the lower terminal holding plate 12. The lower terminal positioning plate 16 has a rear edge 161 and is formed with four second notches 160 that extend from the rear edge 161 toward the front wall 10 to permit the upright tail portions 20, 30 of the first and second sets of conductive terminals 2,3 to extend downwardly through the lower terminal positioning plate 16 and to project beyond a bottom edge of the front wall 10. The second notches 160 are longer than the first notches 150.

Each of the upper and lower terminal holding plates 11,12 has a bottom side formed with four terminal retaining grooves 111, 121 that extend forwardly relative to the front wall 10. The upper and lower sets of through holes 117, 127 are communicated respectively with the terminal retaining grooves 111, 121. The front sections of the horizontal contact portions 21, 31 of the first and second sets of conductive terminals 2,3 are mounted respectively in the terminal retaining grooves 111, 121.

The horizontal contact portions 21 of the first set of conductive terminals 2 are longer than the horizontal contact portions 31 of the second set of conductive terminals 3 such that the upright tail portions 20 of the first set of conductive terminals 2 are disposed farther from the front wall 10 than the upright tail portions 30 of the second set of conductive terminals 3. Each of the horizontal contact portions 21 of the first set of conductive terminals 2 is aligned vertically with a respective one of the horizontal contact portions 31 of the second set of conductive terminals 3.

Figure 3:
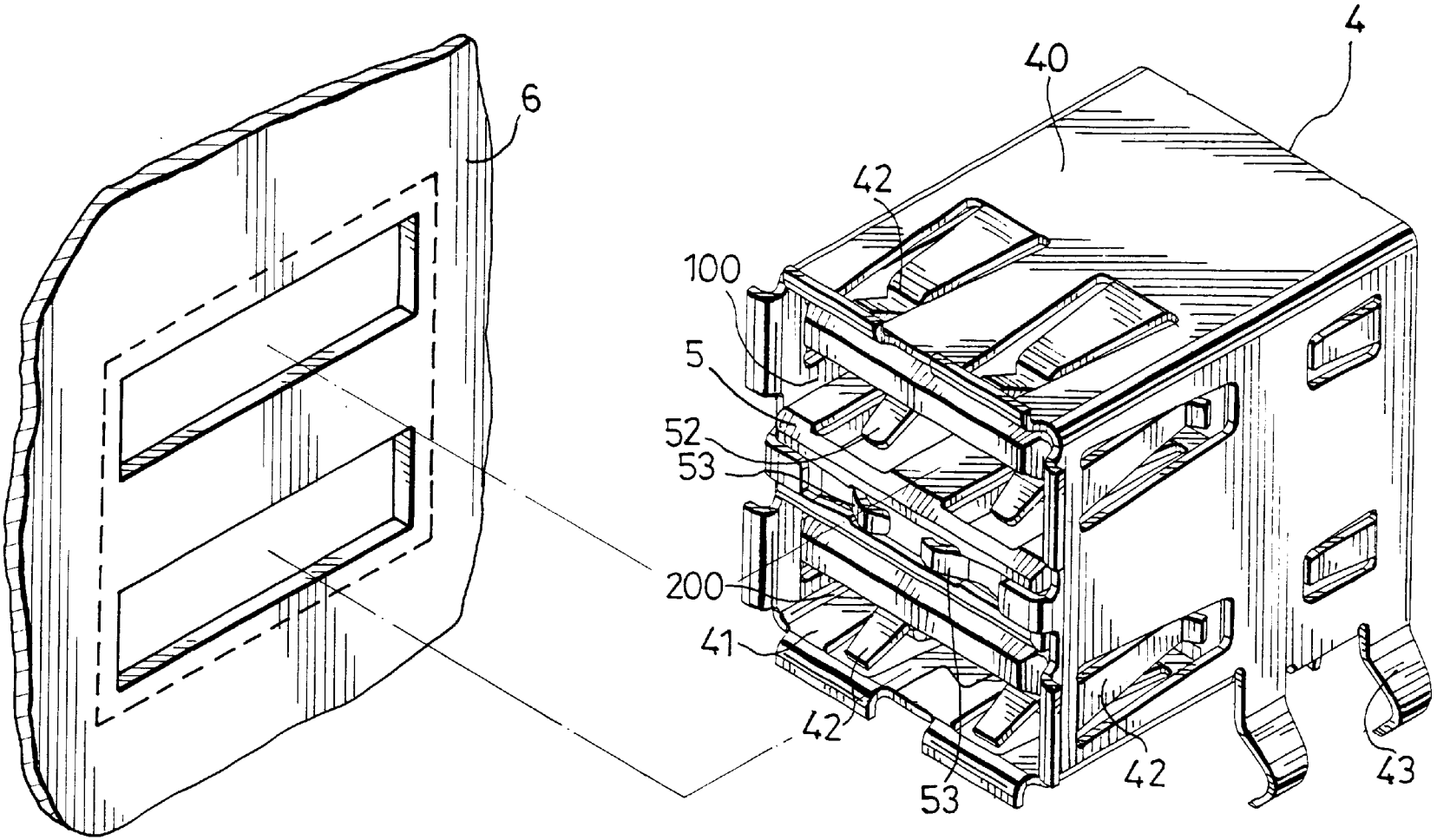
FIG. 3 is a front perspective view of the preferred embodiment.
Figure 4:
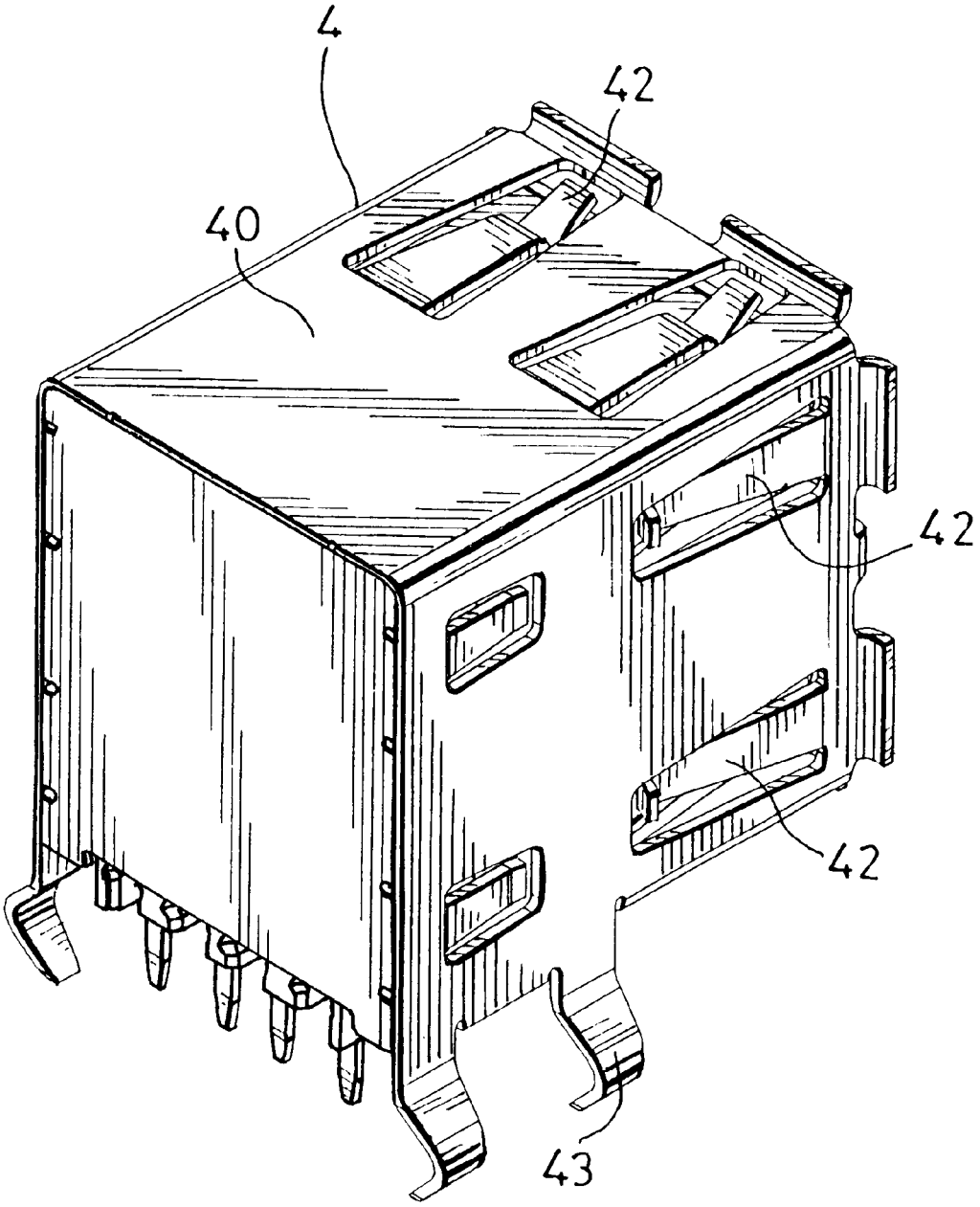
FIG. 4 is a rear perspective view of the preferred embodiment.

With further reference to FIGS. 3 and 4, the first metal shield 4 includes first top and bottom walls 40,41, first left and right walls 45,46 interconnecting the first top and bottom walls 40,41, and a rear wall 44 connected to rear edges of the first left and right walls 45,46. The first metal shield 4 encloses the terminal holding frame 1 such that the rear wall 44 is disposed rearwardly of the upper and lower terminal positioning plates 15,16 so as to enhance electromagnetic shielding of the first and second sets of conductive terminals 2,3. Each of the first top, bottom, left and right walls 40,41,45,46 has a plurality of resilient tongues 42 that are formed by punching and that are bent so as to project into an interior of the first metal shield 4. Preferably, each of the first left and right walls 45,46 has a bottom edge formed with two downwardly extending board inserting legs 43 that extend into mounting holes of a printed circuit board (not shown) when the electrical connector of the present invention is mounted on the printed circuit board.

The second metal shield 5 includes second top and bottom walls 50,51, and second left and right walls 55,56 that interconnect the second top and bottom walls 50,51. The second top, bottom, left and right walls 55,56 cooperatively form a front open end. The second metal shield 5 further includes a pair of resilient grounding strips 53 that extend into the front open end from a respective one of the second left and right walls 55,56. The second metal shield 5 encloses the partition plate 13 such that the resilient grounding strips 53 are disposed forwardly of the partition plate 13. Thus, as shown in FIG. 3, when the electrical connector is installed in a housing 6 of an electronic appliance, the resilient grounding strips 53 abut against the housing 6 for grounding purposes. Preferably, each of the second top and bottom walls 50,51 of the second metal shield 5 is punched to form a plurality of resilient tongues 52 that are bent so as to project into an interior of the first metal shield 4 when the second metal shield 5 is mounted on the partition plate 13. Under such a condition, the upper and lower terminal holding plates 11, 12 cooperate with the partition plate 13 to define upper and lower sockets 100, 200 (see FIG. 3) for receiving two mating electrical connectors (not shown). The resilient tongues 52 formed on the second top and bottom walls 50,51 of the second metal shield 5 extend into the upper and lower sockets 100, 200, and cooperate with the resilient tongues 42 on the first metal shield 4 to provide a resilient clamping force on the mating electrical connector (not shown). Preferably, the partition plate 13 is formed with upper and lower grooves 18 that extend forwardly from the front wall 10 of the terminal holding frame 1 and that permit a wider degree of movement for the resilient tongues 52 on the second top and bottom walls 50,51 of the second metal shield 5.

The resilient tongues 42 on the first top, bottom, and left and right walls 40,41,45,46 of the first metal shield 4 further abut against the terminal holding frame 1, thereby retaining the first metal shield 4 on the terminal holding frame 1 and consequently preventing undesired disengagement therebetween. Preferably, the second left and right walls 55,56 of the second metal shield 5 are formed with two resilient tongues 520 (see FIG. 1) that project outwardly thereof and that abut against the first left and right walls 45,46 of the first metal shield 4 in order to prevent disengagement between the first and second metal shields 4,5.

With this invention thus explained, it is apparent that numerous modifications and variations can be made without departing from the scope and spirit of this invention. It is therefore intended that this invention be limited only as indicated in the appended claims.

I claim:

1. An electrical connector, comprising:

first and second sets of conductive terminals, each of said conductive terminals in each of said first and second sets having a horizontal contact portion with front and rear sections, and an upright tail portion extending downwardly from said rear section of said horizontal contact portion;

a terminal holding frame formed from an insulator material and including a front wall, upper and lower terminal holding plates extending forwardly and horizontally from said front wall, a partition plate extending forwardly and horizontally from said front wall between said upper and lower terminal holding plates, and upper and lower terminal positioning plates extending rearwardly and horizontally from said front wall such that said upper terminal positioning plate is disposed at an elevation between said upper and lower terminal holding plates, and such that said lower terminal positioning plate is disposed at an elevation below said lower terminal holding plate, said front wall being formed with an upper set of through holes to permit said front sections of said horizontal contact portions of said first set of conductive terminals to extend therethrough for mounting said front sections of said horizontal contact portions of said first set of conductive terminals on said upper terminal holding plate, said upper terminal positioning plate having a rear edge and being formed with a plurality of first notches that extend from said rear edge toward said front wall to permit said upright tail portions of said first set of conductive terminals to extend downwardly through said upper terminal positioning plate, said front wall being further formed with a lower set of through holes to permit said front sections of said horizontal contact portions of said second set of conductive terminals to extend therethrough for mounting said front sections of said horizontal contact portions of said second set of conductive terminals on said lower terminal holding plate, said lower terminal positioning plate having a rear edge and being formed with a plurality of second notches that extend from said rear edge toward said front wall to permit said upright tail portions of said first and second sets of conductive terminals to extend downwardly through said lower terminal positioning plate and to project beyond a bottom edge of said front wall;

a first metal shield including first top and bottom walls, first left and right walls interconnecting said first top and bottom walls, and a rear wall connected to a rear edge of at least one of said first top, bottom, left and right walls, said first metal shield enclosing said terminal holding frame such that said rear wall is disposed rearwardly of said upper and lower terminal positioning plates so as to enhance electromagnetic shielding of said first and second sets of conductive terminals; and a second metal shield including second top and bottom walls, and second left and right walls interconnecting said second top and bottom walls, said second top, bottom, left and right walls cooperatively forming a front open end, said second metal shield further including a pair of resilient grounding strips that extend into said front open end from a respective one of said second left and right walls, said second metal shield enclosing said partition plate such that said resilient grounding strips are disposed forwardly of said partition plates, wherein at least one of said second left and right walls of said second metal shield is formed with a resilient tongue extending outwardly for engaging inner sides of said first left and right walls of said first metal shield;

whereby, when said electrical connector is installed in a housing of an electronic appliance, said resilient grounding strips on said second metal shield are adapted to abut against the housing of the electronic appliance for grounding purposes.

2. The electrical connector as defined in claim 1, wherein at least one of said first top, bottom, left and right walls of said first metal shield and said second top and bottom walls of said second metal shield is formed with a resilient tongue that projects into an interior of said first metal shield.

* * * * *